US012403383B2

(12) United States Patent
Jawaid

(10) Patent No.: US 12,403,383 B2
(45) Date of Patent: Sep. 2, 2025

(54) BOXING GLOVE WITH SHOCK-ABSORBING LATTICE

(71) Applicant: Pulse Sports, LLC, West Hollywood, CA (US)

(72) Inventor: Imran Jawaid, Los Angeles, CA (US)

(73) Assignee: PULSE SPORTS, LLC, West Hollywood, CA (US)

( * ) Notice: Subject to any disclaimer, the term of this patent is extended or adjusted under 35 U.S.C. 154(b) by 0 days.

(21) Appl. No.: 17/944,072

(22) Filed: Sep. 13, 2022

(65) Prior Publication Data

US 2023/0080887 A1 Mar. 16, 2023

Related U.S. Application Data

(60) Provisional application No. 63/243,661, filed on Sep. 13, 2021.

(51) Int. Cl.

| | |
|---|---|
| ***A63B 71/14*** | (2006.01) |
| *A41D 13/08* | (2006.01) |
| *A41D 19/015* | (2006.01) |

(52) U.S. Cl.

CPC ..... *A63B 71/145* (2013.01); *A41D 13/08* (2013.01); *A41D 13/081* (2013.01); *A41D 13/082* (2013.01); *A41D 13/084* (2013.01); *A41D 19/01523* (2013.01); *A63B 71/14* (2013.01); *A63B 2244/102* (2013.01)

(58) Field of Classification Search

CPC .... A41D 13/08; A41D 13/081; A41D 13/082; A41D 13/084; A41D 19/01523; A63B 71/14; A63B 71/145; A63B 2244/102

USPC ..... 2/18

See application file for complete search history.

(56) References Cited

U.S. PATENT DOCUMENTS

| | | | | | |
|---|---|---|---|---|---|
| 1,098,124 | A * | 5/1914 | Nixon, Jr. | A63B 71/145 | 2/18 |
| 3,540,059 | A * | 11/1970 | Kennedy | A63B 71/145 | 2/18 |
| 3,855,633 | A * | 12/1974 | Rhee | A63B 71/145 | 473/518 |
| 3,945,045 | A * | 3/1976 | Rhee | A63B 71/14 | 2/18 |
| 4,425,668 | A * | 1/1984 | Wen-Jen | A63B 71/145 | 2/18 |
| 4,603,439 | A * | 8/1986 | Golomb | A63B 71/145 | 2/18 |
| 5,146,624 | A * | 9/1992 | Bruckner | A63B 71/145 | 2/18 |
| 5,435,012 | A * | 7/1995 | Lincoln | A41D 31/14 | 2/159 |
| 6,014,770 | A * | 1/2000 | Spector | A63B 71/145 | 2/161.1 |

(Continued)

*Primary Examiner* — Khaled Annis
*Assistant Examiner* — Dakota Marin
(74) *Attorney, Agent, or Firm* — Kunzler Bean & Adamson

(57) ABSTRACT

Disclosed herein is a boxing glove that includes an interior liner. The interior liner comprises an exterior surface and an interior surface. The interior surface defines an interior pocket configured to receive a hand of a user. The boxing glove also includes a shock-absorption layer that is coupled with at least a portion of the exterior surface of the interior liner. The shock-absorption layer includes a lattice comprising a three-dimensional arrangement of at least one repeating pattern of interconnected cells.

21 Claims, 11 Drawing Sheets

(56) References Cited

U.S. PATENT DOCUMENTS 6,704,936 B1 * 3/2004 Carlin ..... A63B 71/145 2/161.1
7,384,380 B2 * 6/2008 Reinbold ..... A63B 71/06 73/12.09
8,082,601 B2 * 12/2011 Yang ..... A63B 71/081 2/455
8,429,765 B2 * 4/2013 Africa ..... A41D 27/28 2/160
8,961,733 B2 * 2/2015 Dodd ..... A47C 7/00 438/156
10,099,107 B2 * 10/2018 Liang ..... A41D 3/06
10,376,770 B2 * 8/2019 Wittman ..... A63B 71/145
10,555,566 B2 * 2/2020 Foster ..... A41D 19/002
11,033,796 B2 * 6/2021 Bologna ..... A63B 71/1225
2004/0177431 A1 * 9/2004 Ferrer ..... A41D 19/01523 2/161.8
2008/0172779 A1 * 7/2008 Ferguson ..... A41D 31/285 2/455
2011/0041780 A1 * 2/2011 Hurwitz ..... A01K 13/007 119/850
2011/0277205 A1 * 11/2011 Cuadrado ..... A41D 19/01523 2/18
2012/0315460 A1 * 12/2012 LaFlamme ..... B32B 27/06 156/306.6
2013/0014306 A1 * 1/2013 Mechling ..... A42B 3/20 2/169
2013/0019366 A1 * 1/2013 Mechling ..... A41D 13/06 2/18
2015/0113694 A1 * 4/2015 Ramos ..... A63B 71/145 2/18
2017/0001097 A1 * 1/2017 Ferrer ..... A41D 19/01523
2018/0099206 A1 * 4/2018 Staub ..... A63B 71/10
2020/0146367 A1 * 5/2020 Montoya ..... A41D 3/02
2021/0146227 A1 * 5/2021 Bhagwat ..... A41D 19/04
2021/0246959 A1 * 8/2021 Kabaria ..... B29C 64/386
2022/0007765 A1 * 1/2022 Nyström ..... A43B 7/32
2024/0245977 A1 * 7/2024 Clement ..... B33Y 80/00

* cited by examiner

BOXING GLOVE WITH SHOCK-ABSORBING LATTICE

CROSS-REFERENCE TO RELATED APPLICATION

This application claims the benefit of U.S. Provisional Patent Application No. 63/243,661, filed Sep. 13, 2021, which is incorporated herein by reference.

FIELD

This disclosure relates generally to boxing gloves, and more particularly to boxing gloves having improved shock-absorbing characteristics.

BACKGROUND

A typical boxing glove includes one or more layers of solid foam material, which is designed to provide rigidity and shape to the boxing glove. The solid foam material also helps to absorb the forces generated by impacts of the boxing glove against an object or an opponent. The solid foam material used in typical boxing gloves includes open-cell and/or closed-cell foams, such as polyurethane foam, high-density foam, and the like. These foams have a non-uniform or non-organized cellular structure, which results in a relatively low nodal connectivity and a failure mechanism dominated by bending of the structure. Accordingly, typical foams used in boxing gloves have relatively low mechanical strength and stiffness. To compensate for such shortcomings, boxing gloves are manufactured with extra thick layers of foam material or extremely dense layers of foam material. Such compensation techniques add extra manufacturing costs and weight to boxing gloves.

SUMMARY

The subject matter of the present application has been developed in response to the present state of the art, and in particular, in response to the problems and needs of conventional boxing gloves that have not yet been fully solved. In view of the foregoing problems and needs of boxing gloves, the subject matter of the present application has been developed to provide a boxing glove that overcomes many of the shortcomings of the prior art. The boxing glove disclosed herein includes a shock-absorbing feature that overcomes the shortcomings of solid foam materials used in conventional boxing gloves. Generally, according to certain examples, the shock-absorbing feature includes a highly uniform and highly organized lattice with relatively high nodal connectivity, mechanical strength, and stiffness compared to solid foam materials. Moreover, the lattice is made by an additive manufacturing technique, which promotes the manufacturing of complex shapes and cellular structure with precision and accuracy not capable with the manufacture of solid foam materials.

Disclosed herein is a boxing glove that comprises an interior liner comprising an exterior surface and an interior surface. The interior surface defines an interior pocket configured to receive a hand of a user. The boxing glove also comprises a shock-absorption layer, coupled with at least a portion of the exterior surface of the interior liner. The shock-absorption layer comprises a lattice comprising a three-dimensional arrangement of at least one repeating pattern of interconnected cells. The preceding subject matter of this paragraph characterizes example 1 of the present disclosure.

Each cell of the at least one repeating pattern of interconnected cells has a hexagonal shape. The preceding subject matter of this paragraph characterizes example 2 of the present disclosure, wherein example 2 also includes the subject matter according to example 1, above.

Each cell of the at least one repeating pattern of interconnected cells comprises a plurality of interconnected cylinders. The preceding subject matter of this paragraph characterizes example 3 of the present disclosure, wherein example 3 also includes the subject matter according to any one of examples 1-2, above.

The lattice comprises a three-dimensional arrangement of multiple repeating patterns of interconnected cells. Each one of the multiple repeating patterns of interconnected cells is different than at least one other of the multiple repeating patterns of interconnected cells. The preceding subject matter of this paragraph characterizes example 4 of the present disclosure, wherein example 4 also includes the subject matter according to any one of examples 1-3, above.

A shape of each cell of each one of the multiple repeating patterns of interconnected cells is different than the shape of each cell of at least one other of the multiple repeating patterns of interconnected cells. The preceding subject matter of this paragraph characterizes example 5 of the present disclosure, wherein example 5 also includes the subject matter according to example 4, above.

A size of each cell of each one of the multiple repeating patterns of interconnected cells is different than the size of each cell of at least one other of the multiple repeating patterns of interconnected cells. The preceding subject matter of this paragraph characterizes example 6 of the present disclosure, wherein example 6 also includes the subject matter according to any one of examples 4-5, above.

The lattice comprises a finger region, a thumb region, an arm region, and a back hand region. The preceding subject matter of this paragraph characterizes example 7 of the present disclosure, wherein example 7 also includes the subject matter according to any one of examples 4-6, above.

The finger region comprises a first repeating pattern of the multiple repeating patterns of interconnected cells. The back hand region comprises a second repeating pattern of the multiple repeating patterns of interconnected cells. The first repeating pattern is different than the second repeating pattern. The preceding subject matter of this paragraph characterizes example 8 of the present disclosure, wherein example 8 also includes the subject matter according to example 7 above.

The first repeating pattern comprises a pattern of differently sized cells. The second repeating pattern comprises a pattern of identically sized cells. The preceding subject matter of this paragraph characterizes example 9 of the present disclosure, wherein example 9 also includes the subject matter according to example 8 above.

A third repeating pattern of the multiple repeating patterns of interconnected cells is located at a transition region between the finger region and the back hand region. A shape of the interconnected cells of the second repeating pattern and the third repeating pattern are the same. The interconnected cells of the third repeating pattern are smaller than the interconnected cells of the second repeating pattern. The preceding subject matter of this paragraph characterizes example 10 of the present disclosure, wherein example 10 also includes the subject matter according to any one of examples 8-9, above.

The lattice further comprises a face sheet defining an interior surface of the finger region, the thumb region, the arm region, and the back hand region of the lattice. The interior liner is attached to the face sheet of the lattice. The preceding subject matter of this paragraph characterizes example 11 of the present disclosure, wherein example 11 also includes the subject matter according to any one of examples 7-10, above.

The lattice comprises a finger region, a thumb region, an arm region, and a back hand region. At least the finger region, the arm region, and the back hand region have a one-piece, seamless, and monolithic construction. The preceding subject matter of this paragraph characterizes example 12 of the present disclosure, wherein example 12 also includes the subject matter according to any one of examples 1-11, above.

The thumb region has a one-piece, seamless, and monolithic construction. The thumb region is attached to the back hand region at an interface. The preceding subject matter of this paragraph characterizes example 13 of the present disclosure, wherein example 13 also includes the subject matter according to example 12 above.

The thumb region comprises a series of protrusions and recesses. The back hand region comprises a series of protrusions and recesses. The protrusions of the thumb region nestably engage the recesses of the back hand region and the recesses of the thumb region nestably engage the protrusions of the back hand region to form the interface. The preceding subject matter of this paragraph characterizes example 14 of the present disclosure, wherein example 14 also includes the subject matter according to example 13 above.

The boxing glove further comprises an outer cover coupled with the lattice so that the lattice is interposed between the outer cover and the interior liner. The preceding subject matter of this paragraph characterizes example 15 of the present disclosure, wherein example 15 also includes the subject matter according to any one of examples 1-14, above.

The lattice comprises a finger region, a thumb region, a back arm region, a back hand region, a front arm region, and a palm region. The lattice defines an interior cavity between the back arm region and the front arm region, and between the back hand region and the palm region. The interior pocket comprises at least a portion of the interior cavity defined by the lattice. The preceding subject matter of this paragraph characterizes example 16 of the present disclosure, wherein example 16 also includes the subject matter according to any one of examples 1-15, above.

The lattice comprises a tightening strap that is tightenable about the interior liner to reduce a size of the interior pocket. The preceding subject matter of this paragraph characterizes example 17 of the present disclosure, wherein example 17 also includes the subject matter according to any one of examples 1-16, above.

A thickness of the lattice varies. The preceding subject matter of this paragraph characterizes example 18 of the present disclosure, wherein example 18 also includes the subject matter according to any one of examples 1-17, above.

Further disclosed herein is a shock-absorption layer for a boxing glove, the shock-absorption layer comprising a lattice comprising a three-dimensional arrangement of at least one repeating pattern of interconnected cells. The preceding subject matter of this paragraph characterizes example 19 of the present disclosure.

Additionally disclosed herein is a method of making a boxing glove. The method comprises additively manufacturing a shock-absorption layer comprising a lattice having a three-dimensional arrangement of at least one repeating pattern of interconnected cells. The at least one repeating pattern of interconnected cells defines an arm region, a back hand region, a thumb region, and a curved finger region. The method also comprises coupling an interior liner to the lattice so that the interior liner defines an interior pocket of the boxing glove. The preceding subject matter of this paragraph characterizes example 20 of the present disclosure.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended numbered paragraphs, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
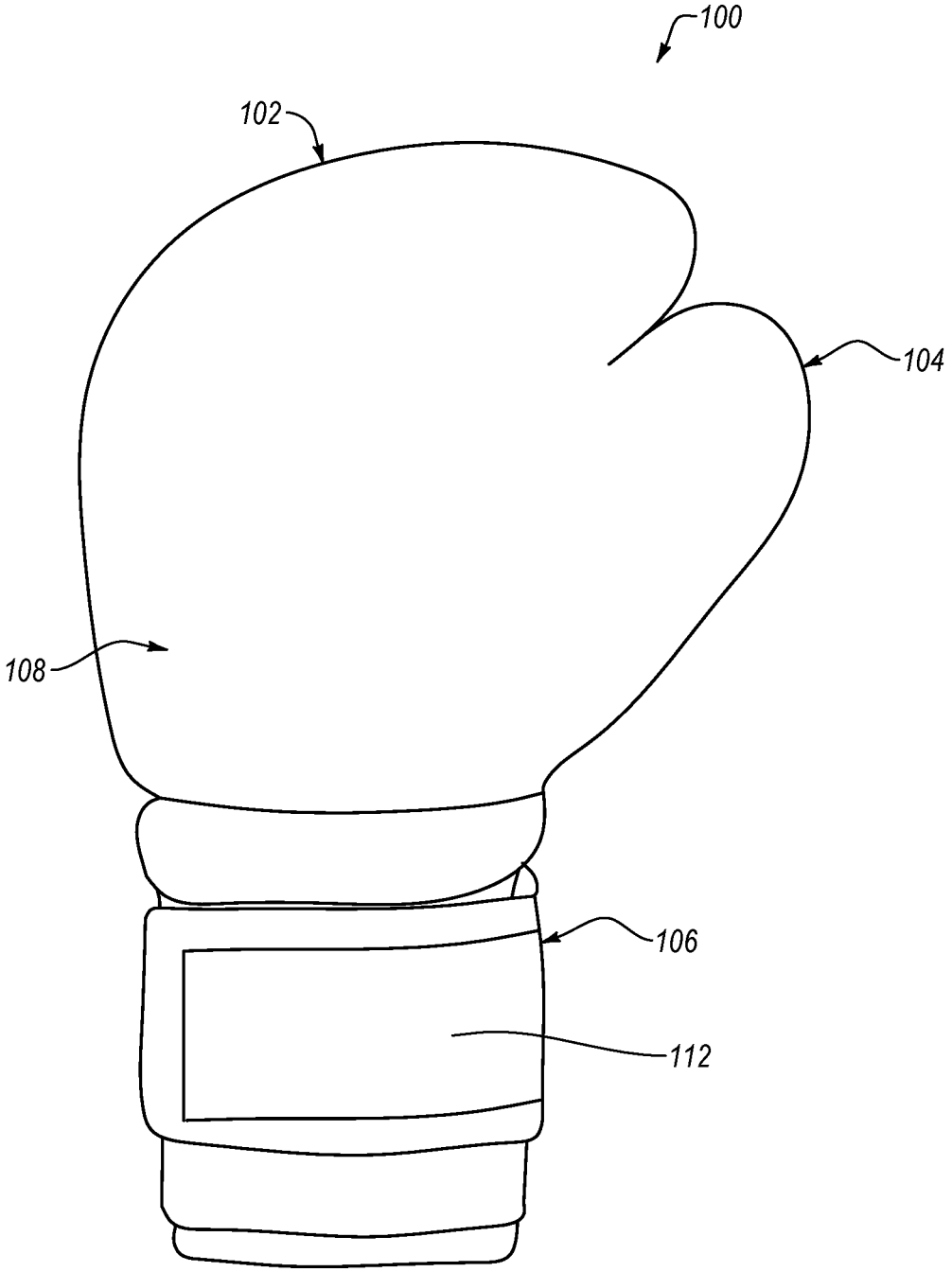
FIG. 1 is a schematic rear view of a boxing glove, according to one or more examples of the present disclosure.
Figure 2:
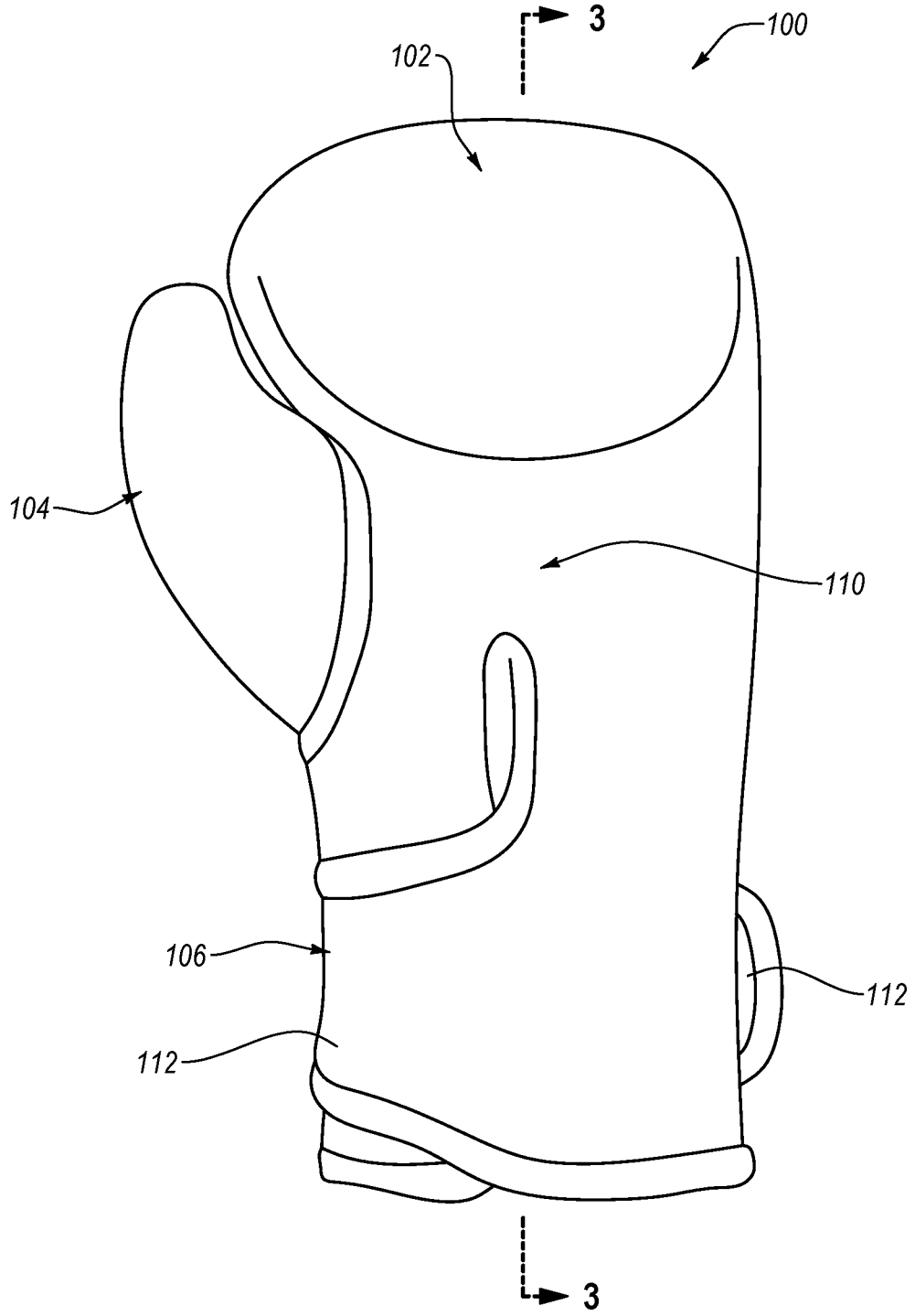
FIG. 2 is a schematic front view of the boxing glove of FIG. 1, according to one or more examples of the present disclosure.

Referring to FIGS. 1 and 2, according to some examples, a rear view and a front view of a boxing glove 100 are shown. The boxing glove 100 includes a finger portion 102, a thumb portion 104, an arm portion 106, a back hand portion 108, and a palm portion 110. When worn by a user, the finger portion 102, the thumb portion 104, the arm portion 106, the back hand portion 108, and the palm portion 110 overlay the fingers, thumb, arm, back of the hand, and a palm of a given arm/hand of the user. As shown in FIGS. 1 and 2, the boxing glove 100 is a left-hand boxing glove designed to be worn on the left hand of the user. Of course, the boxing glove 100 can be designed to be worn on the right hand of the user. The finger portion 102 is curled, relative to the palm portion 110, to receive and maintain a user's fingers in a curled position. The thumb portion 104 extends from the palm portion 110 laterally and uprightly away from palm portion 110. The arm portion 106 includes a tightening feature 112 that promotes tightening of the arm portion 106 around the arm of the user near the wrist of the user (e.g., reducing the size of the interior pocket 130). The tightening feature 112 can be any of various tightening features that facilitate selective tightening and untightening around the arm of the user. In the illustrated example, the tightening feature 112 is a strap that includes opposing hook and loop portions (e.g., Velcro®) which is selectively secured together to tightening the tightening features 112. In other examples, the tightening feature 112 includes eyelets and a lace threaded through the eyelets and knotted to tighten the tightening feature 112 around the user's arm.

Figure 3:
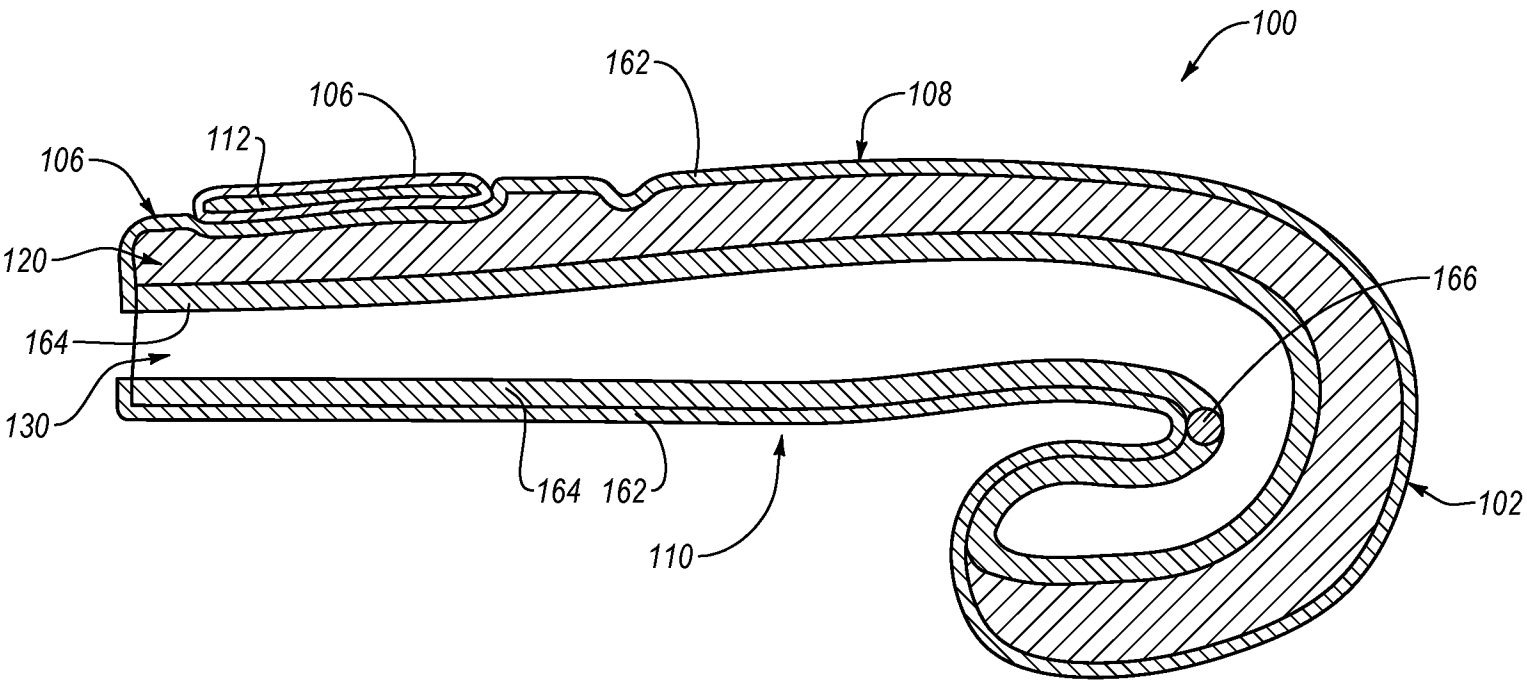
FIG. 3 is a schematic, cross-sectional, side view of the boxing glove of FIG. 1, taken along the line 3-3 of FIG. 2, according to one or more examples of the present disclosure.

Referring to FIG. 3, which is a cross-sectional side view of the boxing glove 100 taken along the line 3-3 of FIG. 2, the boxing glove 100 includes a shock-absorption layer in the form of a lattice 120. The lattice 120 is configured to provide rigidity and shape to the boxing glove 100, as well as to absorb forces generated by impacts of the boxing glove 100, when worn by a user, against an object or an opponent. Accordingly, the lattice 120 acts as a shock-absorber to reduce impact forces on the hand of the user wearing the boxing glove 100 and the object being impacted by the boxing glove 100. The lattice 120 extends along and helps provide structure to the finger portion 102, the thumb portion 104, the arm portion 106, and the back hand portion 108. As shown, the lattice 120 extends along only an exterior side of the finger portion 102 and the thumb portion 104.

The boxing glove 100 further includes an interior liner 164 that defines an interior pocket 130 of the boxing glove 100. The interior liner 164 has an exterior surface and an interior surface. The exterior surface of the interior liner 164 is affixed to an inner surface of the lattice 120. Additionally, the interior liner 164 extends from the lattice 120 along an interior side of the finger portion 102 and the thumb portion 104, and extends along the palm portion 110, and a front side of the arm portion 106. Accordingly, the interior liner 164 overlaps with itself to define the interior pocket 130, which is designed to receive and retain the user's hand. In other words, the interior pocket 130 is sized and shaped to correspond with the size and shape of the user's hand.

Additionally, the boxing glove 100 further includes a grip bar 166 at the intersection of the finger portion 102 and the palm portion 110. The grip bar 166 can be a solid bar or material packed together to form a bar-like feature that is more rigid compared to the surrounding portions of the grip bar 166. The grip bar 166 provides a rigid structure about which the fingers of the user can grip (e.g., wrap around) during use.

In some examples, as shown in FIG. 3, an outer surface of the lattice 120, and the portion of the interior liner 164 that is not affixed to the lattice 120, are overlayed with an outer cover 162. The outer cover 162, which defines an outermost surface of the boxing glove 100, helps protect the lattice 120 in some examples. Alternatively, or additionally, the outer cover 162 promotes a relatively smooth outer surface of the boxing glove 100. The outer cover 162 can be any of various materials, such as leather or synthetic leather.

Figure 4:
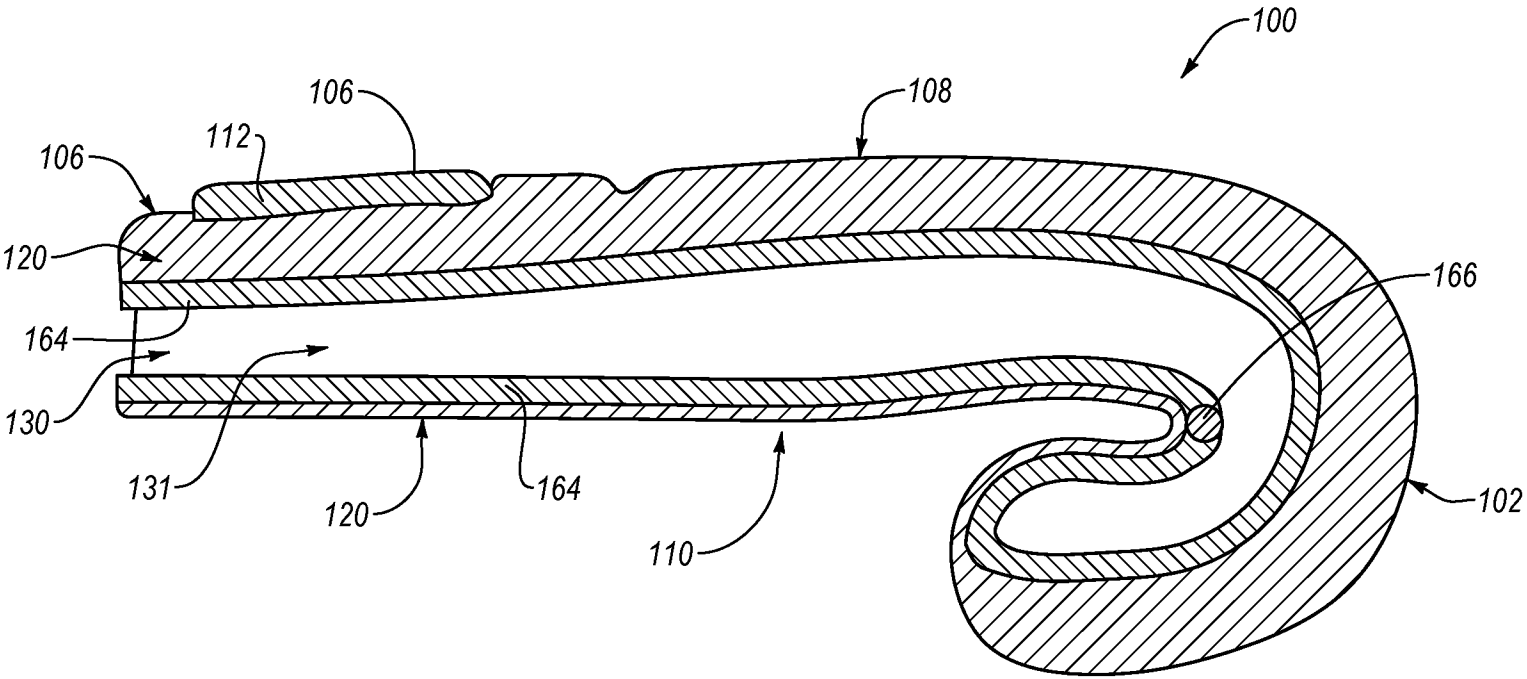
FIG. 4 is a schematic, cross-sectional, side view of a boxing glove, taken along a line similar to the line 3-3 of FIG. 2, according to one or more examples of the present disclosure.
Figure 5:
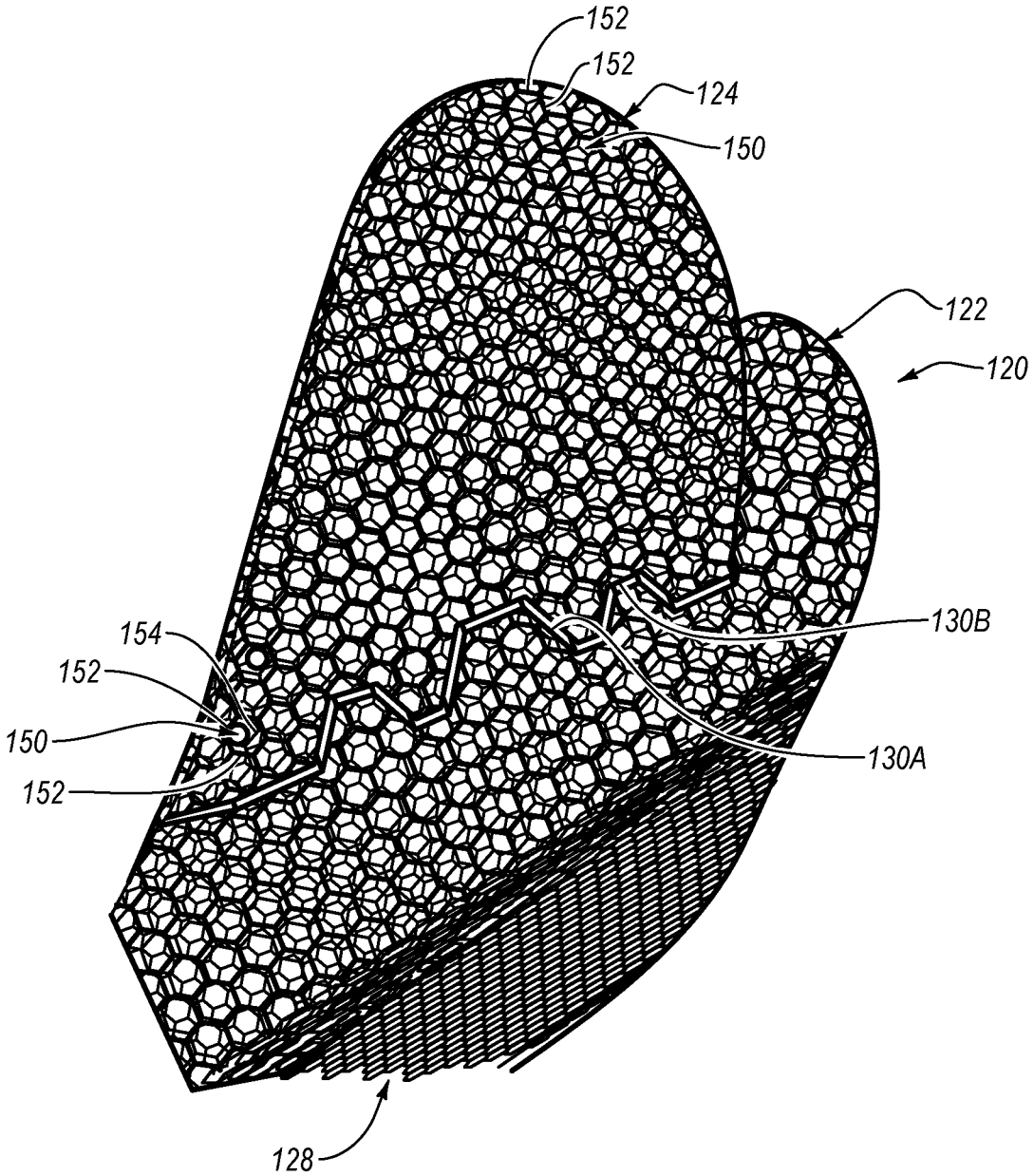
FIG. 5 is a schematic perspective view of a lattice of the boxing glove of FIG. 1, according to one or more examples of the present disclosure.
Figure 6:
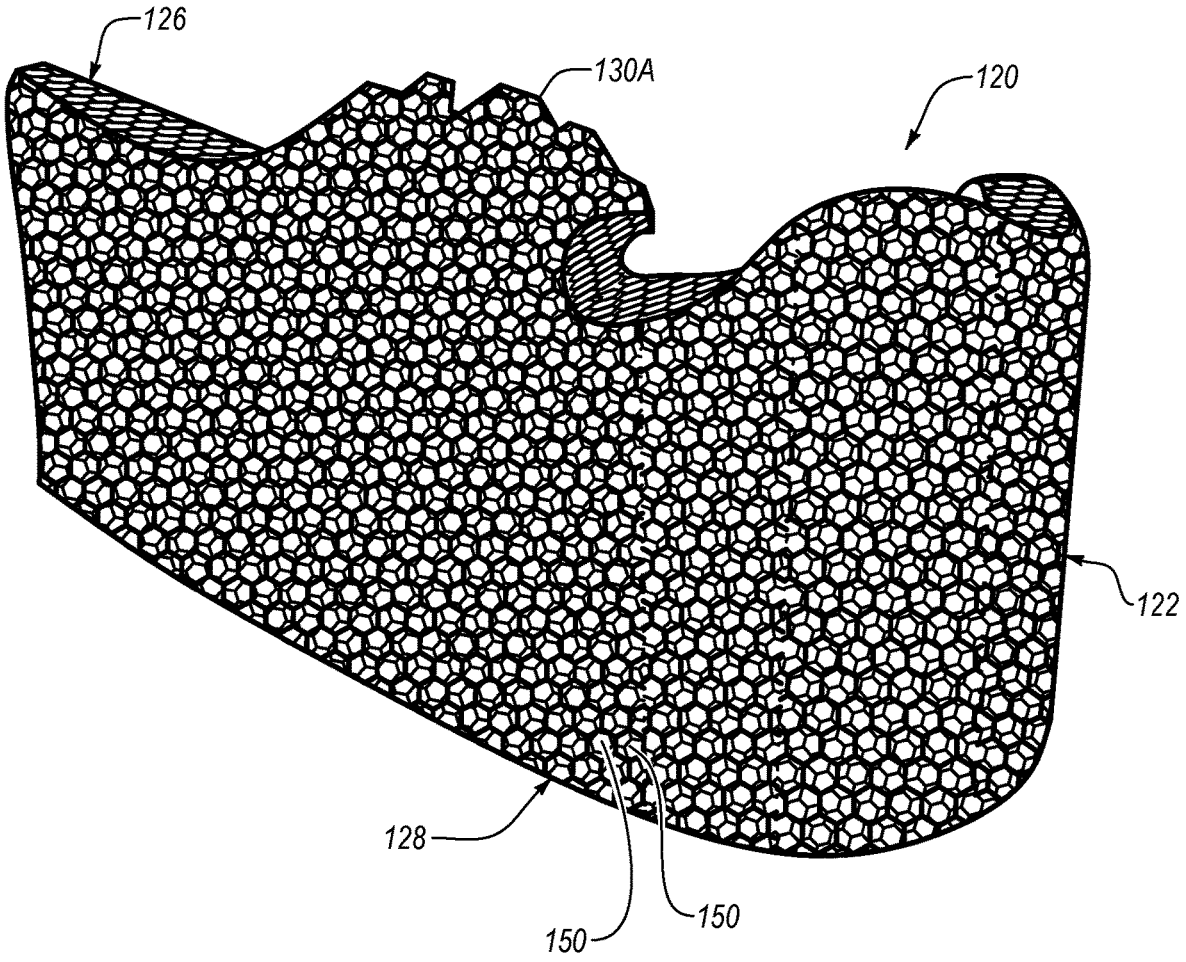
FIG. 6 is a schematic perspective view of a lattice of the boxing glove of FIG. 1, shown with a thumb region removed for highlighting other features of the lattice, according to one or more examples of the present disclosure.

Referring to FIG. 4, in alternative examples, the boxing glove 100 does not include an outer cover 162. Rather, the lattice 120 defines an outermost surface of the boxing glove 100. For example, the lattice 120 helps form the back side and front side of the arm portion 106, including the tightening feature 112, helps form the back hand portion 108, helps form the palm portion 110, and overlaps itself to define the interior side of the finger portion 102 and the thumb portion 104. Accordingly, the lattice 120 itself has a glove-like shape having an interior cavity 131 that defines the interior pocket 130. A thickness of the lattice 120 defining the exterior side of the arm portion and the finger portion 102 can be less than the thickness of the lattice 120 defining the interior side of the arm portion and the finger portion 102. Accordingly, the thickness of the lattice 120 varies from portion to portion of the boxing glove 100 in some examples.

Figure 7:
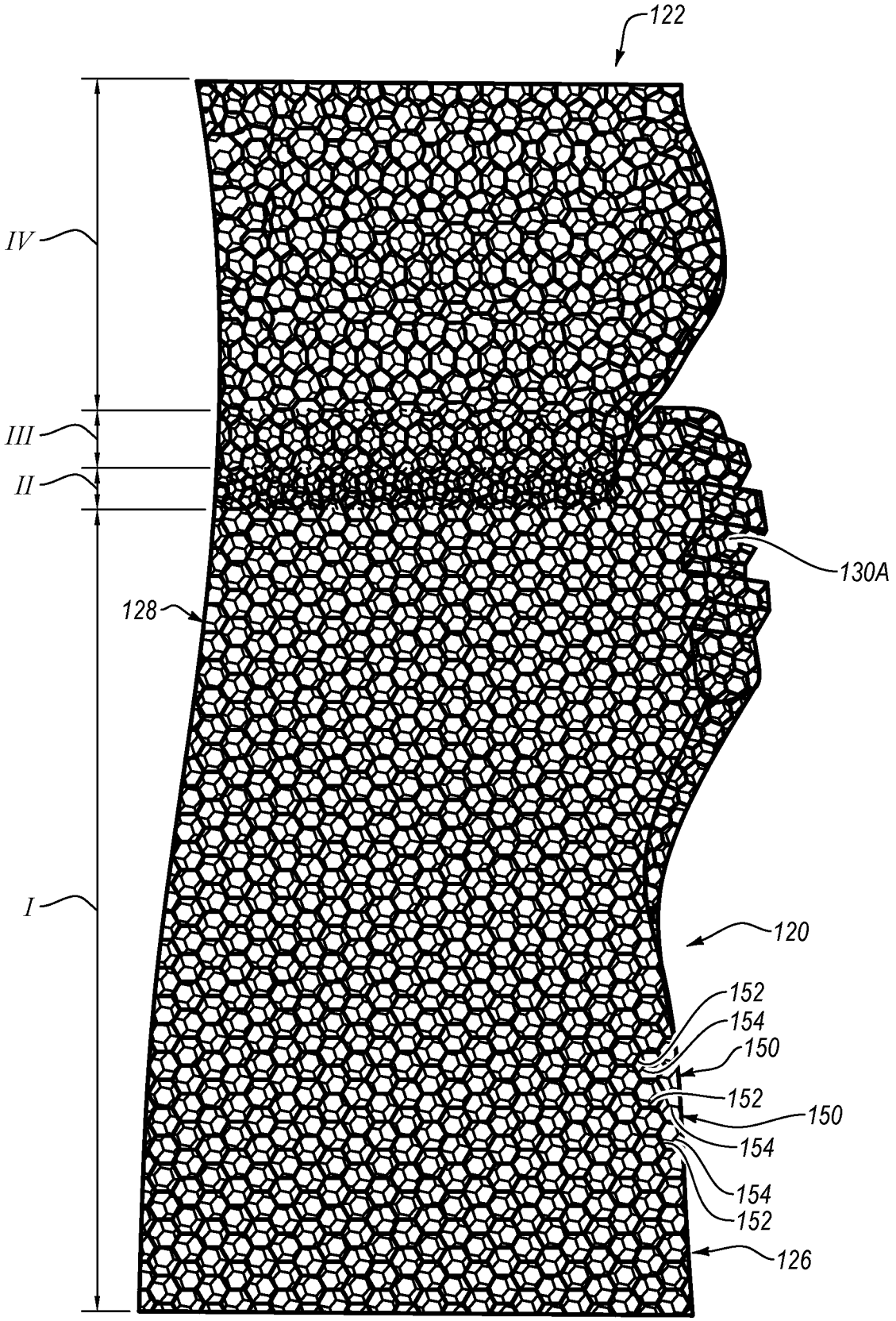
FIG. 7 is a schematic front view of the lattice of the boxing glove of FIG. 1, shown with a thumb region of the lattice removed for highlighting other features of the lattice, according to one or more examples of the present disclosure.
Figure 8:
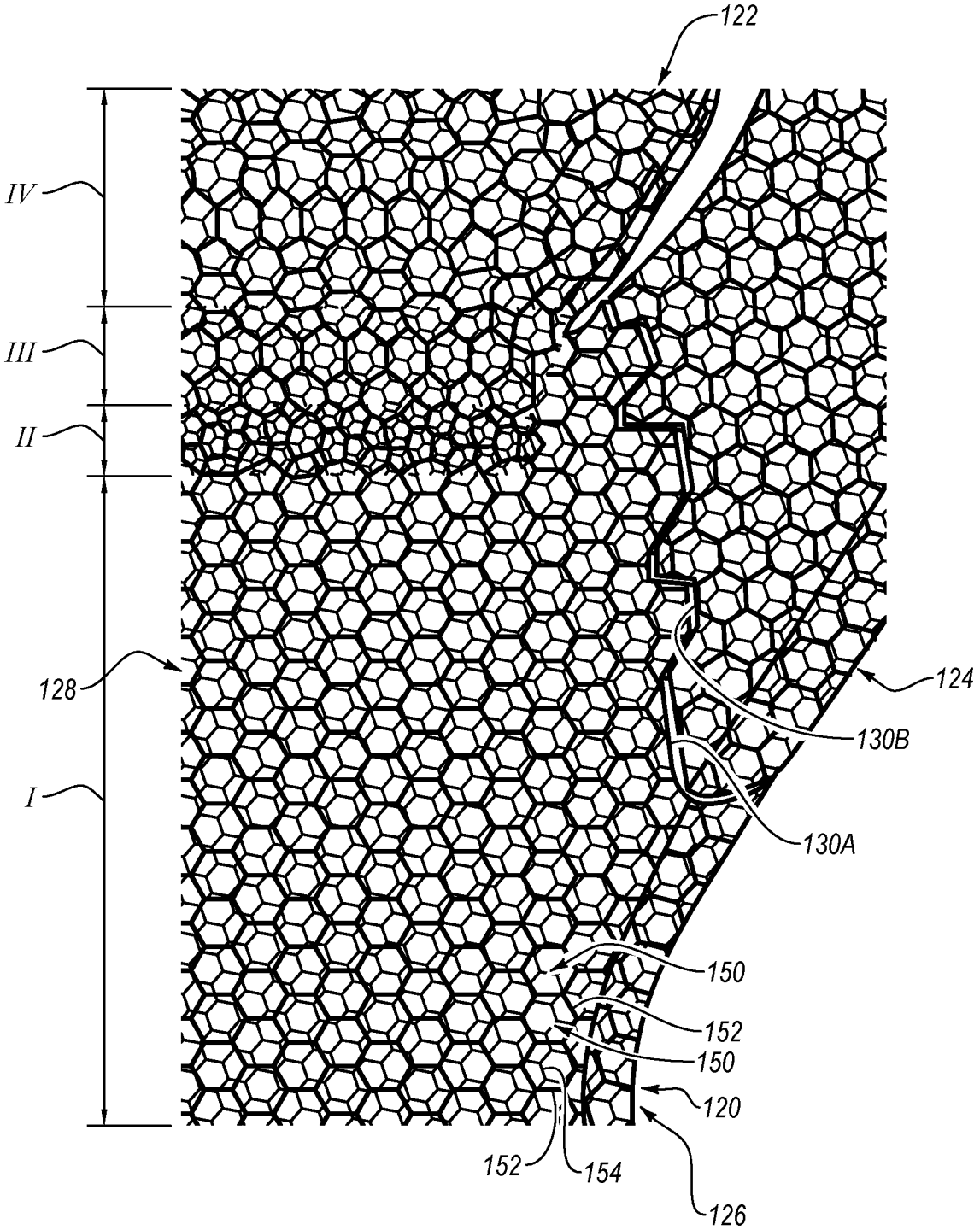
FIG. 8 is a schematic front view of a portion of the lattice of the boxing glove of FIG. 1, according to one or more examples of the present disclosure.
Figure 9:
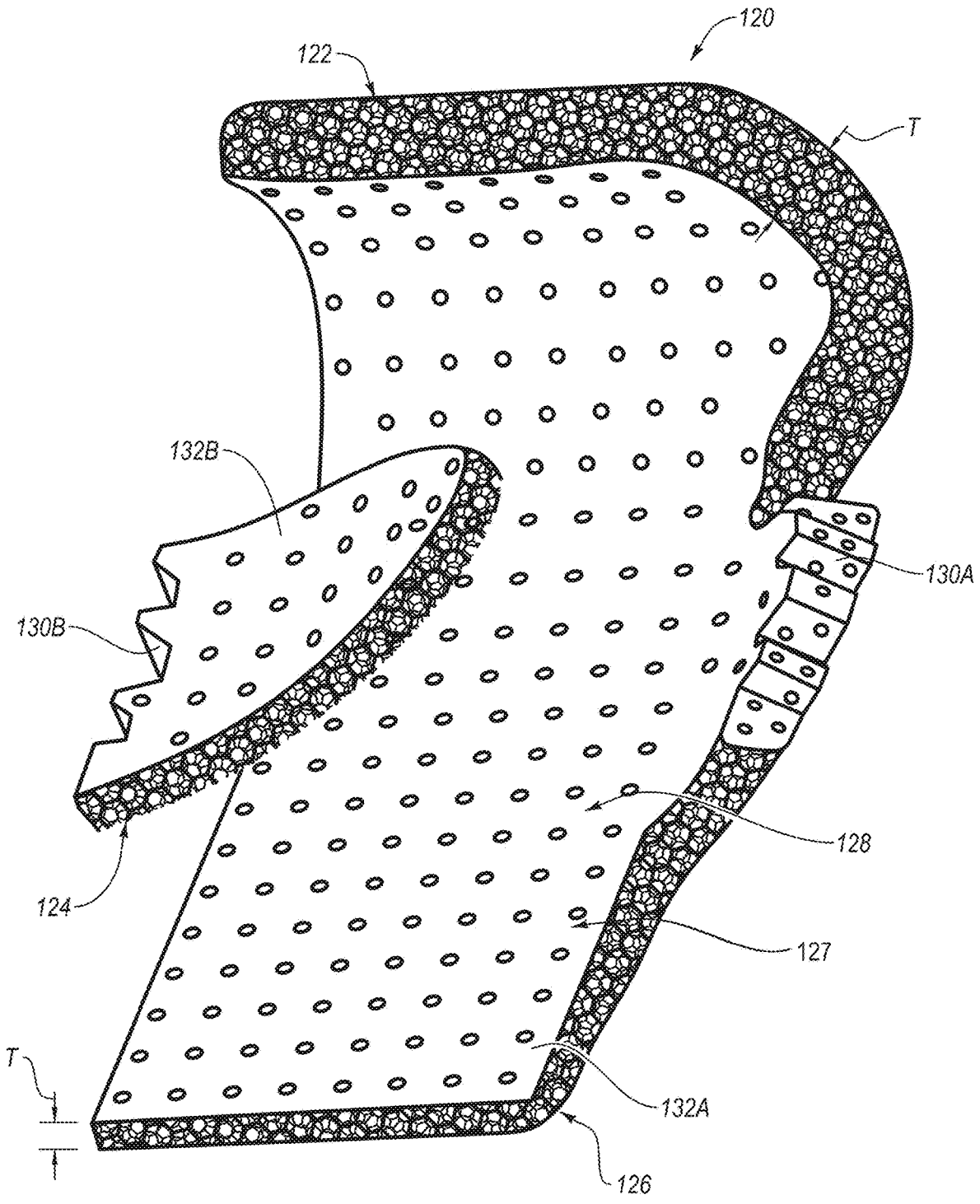
FIG. 9 is a schematic perspective view of a lattice of a boxing glove, shown with a thumb region of the lattice detached from the rest of the lattice, according to one or more examples of the present disclosure.

As shown in FIGS. 5-10, the lattice 120 provides a frame for defining the overall shape of the boxing glove 100. Therefore, in certain examples, the lattice 120 has a finger region 122 (i.e., knuckle region), a thumb region 124, an arm region 126, and a back hand region 128. The lattice 120 of FIG. 4 also has a front arm region, a palm region, and a front arm region. The lattice 120 has a thickness T that varies from region to region (see, e.g., FIG. 9). For example, the arm region 126 of the lattice 120 is thinner than the back hand region 128, which is thinner than the finger region 122. As shown in FIG. 9, a connection region 127 seamlessly connects together the arm region 126 and the back hand region 128. In some examples, as shown, the connection region 127 has a variable thickness across the region to seamlessly transition from the thickness of the arm region 126 to the thickness of the back hand region 128. In some examples, the entirety of the lattice 120, including the thumb region 124, has a one-piece monolithic and seamless construction. Accordingly, in such examples, the lattice 120 has a seamless transition between all regions of the lattice 120.

However, in certain examples, as shown, the entirety of the lattice 120 does not have a one-piece monolithic construction. In these examples, for ease in manufacturing, the thumb region 124 is formed separately from and attached to the rest of the lattice 120. Therefore, the thumb region 124, while being separately formed, has a one-piece monolithic and seamless construction, and the finger region 122, the arm region 126, and the back hand region 128 together have a one-piece monolithic and seamless construction. The thumb region 124 is attached to the back hand region 128 via any of various attachment techniques, such as adhesive bonding, thermal bonding, fastening, and the like. To promote a strong joint between the thumb region 124 and the back hand region 128, the back hand region 128 includes a thumb engagement interface 130A and the thumb region 124 includes a back-hand engagement interface 130B. The thumb engagement interface 130A and the back-hand engagement interface 130B each includes a series of protrusions and recesses. The protrusions in the thumb engagement interface 130A nestably fit into the recesses of the back-hand engagement interface 130B, and vice versa. The nested engagement of multiple protrusions and recesses enforces the joint by providing increased bonding area and physical constraints to relative movement. In some examples, forming the thumb region 124 separately and attaching the thumb region 124 to the back hand region 128 promotes ease and reduces the complexity of making the lattice 120 via additive manufacturing techniques.

Referring to FIGS. 7 and 8, the lattice 120 is made of a three-dimensional arrangement of a repeating (e.g., uniform) pattern of interconnected cells 150. The arrangement is three-dimensional because the repeating pattern of interconnected cells 150 extends in three-dimensions (e.g., along a first plane, such as across a width or length of the lattice 120, and along a second plane, angled with respect to the first plane, such as across a thickness of the lattice 120). Each cell includes multiple segments 152 (e.g., cylinders with substantially circular cross-sectional shapes) joined end-to-end to define an enclosed two-dimensional shape 154. For example, as shown in FIGS. 7 and 8, each cell of a plurality of the cells of the lattice 120 includes six linear segments that define a hexagonal shape. Moreover, each cell shares one segment from at least one adjacent cell. The segments of the lattice 120 are solid rods or cylinders that have a diameter (or corresponding cross-sectional dimension) substantially less than their lengths (e.g., the cylinders are elongated along their lengths). Accordingly, the segments are not thin walls as is the case with foam, but rather are solid cylinders. Moreover, because the segments are individually formed using additive manufacturing techniques, unlike foam cells, the size and shape of the cells of the lattice are predictably and precisely controlled. Although, in the illustrated examples, each cell 150 has a hexagonal shape, in other examples, the cells 150 can have any of various shapes, such as circular, rectangular, triangular, pentagonal, octagonal, and the like. In fact, as disclosed herein, the lattice 120 can have some cells of one shape and other cells of another, different, shape. In the case of cells 150 that have a circular shape, each cell 150 would be defined by a single circular segment where at least a portion of the segment is shared with at least one adjacent cell.

The lattice 120 further comprises multiple stiffness regions in some examples. As shown in FIGS. 7 and 8, the lattice 120 includes a first stiffness region I, a second stiffness region II, a third stiffness region III, and a fourth stiffness region IV. The configuration of the repeating pattern of interconnected cells 150 within the stiffness regions differ. In other words, although the configuration of the repeating pattern within a given stiffness region is the same, the configuration of the repeating pattern can vary from one stiffness region to the next. Accordingly, the stiffness (or alternatively, the flex) of the lattice 120 can vary from region to region by varying the size and/or shape of the cells of the repeating pattern of interconnected cells 150 from region to region. As shown in FIG. 7, although the cells 150 within the first stiffness region I and the second stiffness region II have substantially the same shape (e.g., hexagonal), the size of the cells 150 in the second stiffness region II are greater than in the first stiffness region I, and thus the pitch, areal density, or frequency of the cells 150 in the second stiffness region II is greater than in the first stiffness region I. Accordingly, the overall stiffness of the lattice 120 in the second stiffness region II is greater than in the first stiffness region I. Such a configuration enables the second stiffness region II to act as a flex axis about which the finger region 122 can pivot relative to the back hand region 128. Additionally, the pattern of cells 150 within the stiffness region III and the stiffness region IV are different from each other because the size of the cells in the stiffness region III are the same size and the size of the cells in the stiffness region IV alternate or vary according to a repeating pattern.

Providing different cellular configurations or structures in different regions of the lattice 120 promotes desired performance characteristics in the different areas of the boxing glove 100. For example, in the illustrated examples, the cellular configuration of the finger region 122 promotes a softer feel, while the cellular configuration of the arm region 126 provides a stiffer feel for providing support to the user's arm and wrist. It is recognized that in other examples, the cellular configuration of the regions of the lattice 120 can be different than shown to provide any of various performance characteristics of the boxing glove 100 as desired. It is also recognized that the cellular configuration or structure within a given region can vary across a thickness of the region. For example, an interior portion of the finger region 122 can have a cellular structure that is different than an exterior portion of the finger region 122.

Figure 10:
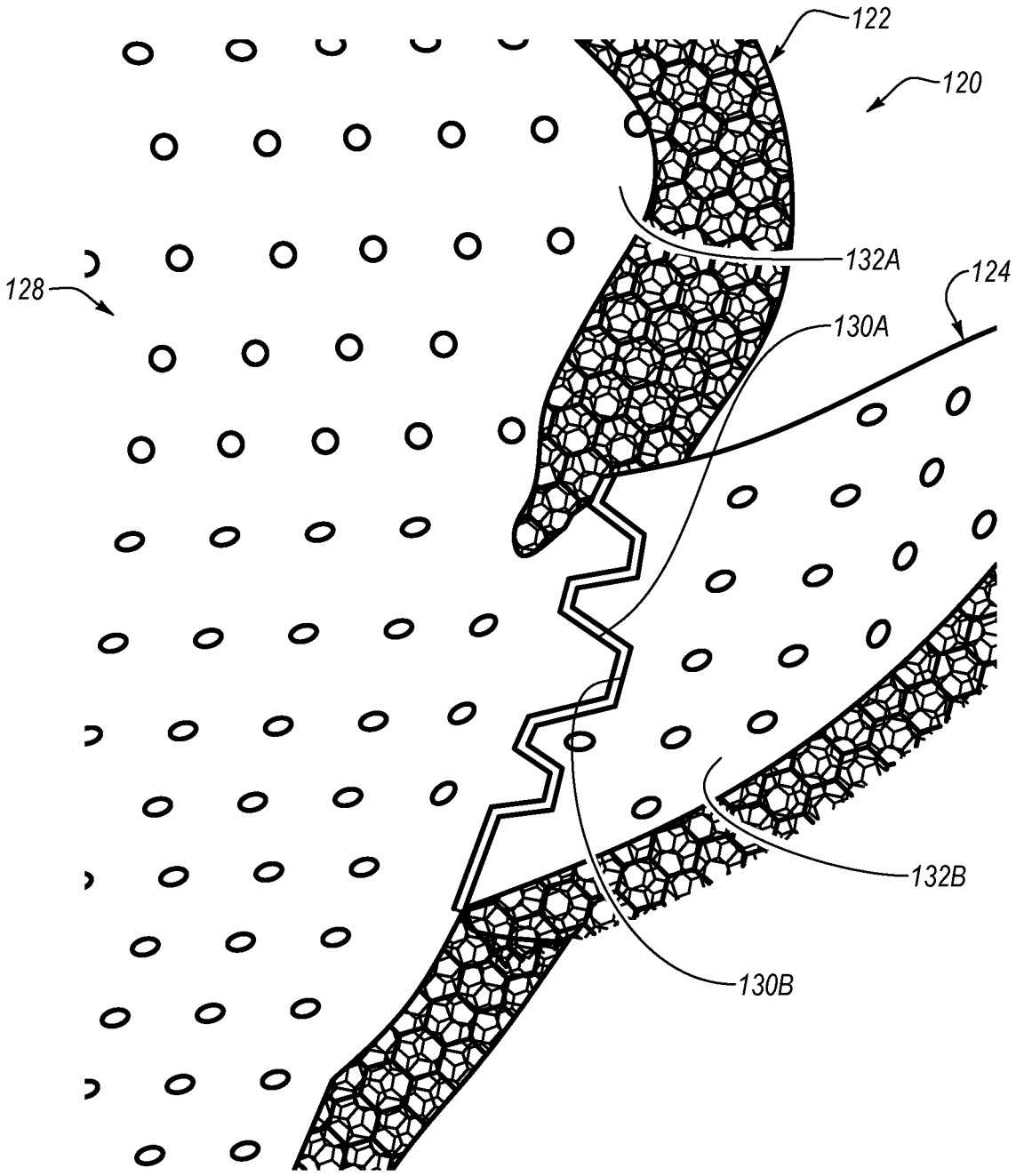
FIG. 10 is a schematic perspective view of a portion of a lattice of a boxing glove, according to one or more examples of the present disclosure.

Referring to FIGS. 9 and 10, in some examples, the lattice 120 includes a face sheet or skin layer that defines an interior surface of the lattice 120. For example, the finger region 122, the arm region 126, and the back hand region 128 include a first face sheet 132A of the lattice 120 and the thumb region 124 includes a second face sheet 132B of the lattice 120. The face sheet is relative smooth compared to the overlaying cellular structure. Accordingly, the face sheet helps to reduce friction between the interior surface of the lattice 120 during impacts with objects. The face sheet also promotes further rigidity of the lattice 120 and provides a surface to which the interior liner 164 can be attached. The face sheet can include a plurality of spaced-apart through-apertures, as shown, which help promote flexibility of the face sheet. However, in some examples, the face sheet does not have through-apertures.

In some examples, such as shown, the thumb engagement interface 130A and the back-hand engagement interface 130B can be defined by corresponding solid layers to promote bonding by increasing bonding area. Although not shown, in some examples, the lattice 120 includes a face sheet or layer that defines an exterior surface of the lattice 120, such that a layer of repeating pattern of cells is sandwiched between two solid layers.

In some examples, the lattice 120 is made by an additive manufacturing technique. More specifically, an additive manufacturing machine builds up the lattice 120 by depositing flowable material (e.g., polymeric material) one layer at a time on top of each other. Because the material is flowable, the layers are thermally bonded together to create a seamless transition between the layers. Moreover, because all the segments of all the cells are manufactured together one layer at a time, the entirety of the lattice 120 (or each one of the thumb region 124 and a combination of the finger region 122, the arm region 126, and the back hand region 128) forms a one-piece monolithic and seamless construction. The polymeric material forming the lattice 120 can be any of various polymeric materials known in the art. Although the material of the lattice 120 has been described as a polymeric material, it is recognized that non-polymeric materials, conducive to additive manufacturing and having properties conducive to providing shock-absorbing functionality for a boxing glove, can be used to form the lattice 120.

Figure 11:
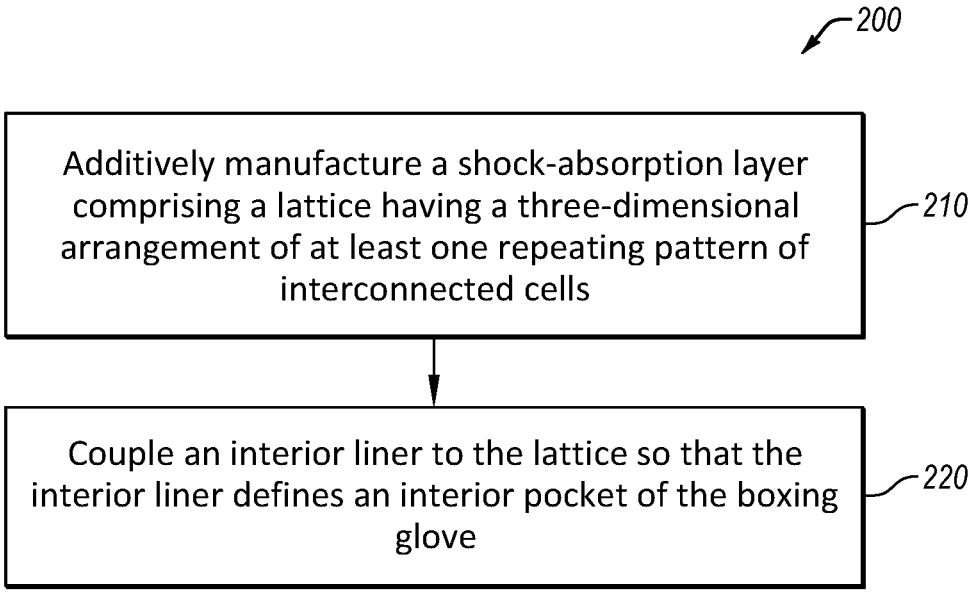
FIG. 11 is a schematic flow chart of a method of making a boxing glove, according to one or more examples of the present disclosure.

Referring to FIG. 11, according to one example, a method 200 of making the boxing glove 100 includes (block 210) additively manufacturing the shock-absorption layer comprising the lattice 120 so that the at least one repeating pattern of interconnected cells of the lattice define an arm region, a back hand region, a thumb region, and a curved finger region. The method 200 also includes (block 220) coupling the interior liner 164 to the lattice 120 so that the interior liner 164 defines an interior pocket 130 of the boxing glove 100. Additive manufacturing of the lattice 120 can be accomplished using any of various additive manufacturing (i.e., 3-D printing) techniques, such as any of various techniques (e.g., fused filament fabrication, powder bed fusion, stereo lithography, and the like) in which material is deposited, joined, or solidified under computer control, with the material being added together layer by layer. The material can be any of various flowable materials, such as plastics, liquids, or powder grains.

In view of the foregoing, in some examples, the boxing glove 100 does not include any solid foam materials. Accordingly, the boxing glove 100 provides adequate shock-absorption capabilities without solid foam materials. However, if desired, some solid foam materials can be utilized in the boxing glove 100, for shock-absorption or for other reasons, such as user comfort and fit, and shaping of the boxing glove.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. Examples of the scope of the present subject matter can be found in the following numbered paragraphs.

The invention claimed is:

1. A boxing glove, comprising:

an interior liner, comprising an exterior surface and an interior surface, wherein the interior surface defines an interior pocket configured to receive a hand of a user;

a shock-absorption layer, comprising a lattice comprising:

a three-dimensional arrangement of at least one additively manufactured repeating pattern of interconnected cells, the lattice further comprising at least an arm region, a back hand region, and a connection region seamlessly connecting together the arm region and the back hand region, wherein the arm region has a first thickness, the back hand region has a second thickness, and the connection region has a variable thickness, and wherein the first thickness is different than the second thickness; and a rigid face sheet co-manufactured with the at least one additively manufactured repeating pattern of interconnected cells of the lattice, the rigid face sheet is made of the same material as the at least one additively manufactured repeating pattern of interconnected cells and is coupled to the interior liner; and wherein the lattice further comprises a thumb region that is directly attached to the back hand region at an interface.

2. The boxing glove according to claim 1, wherein each cell of the at least one repeating pattern of interconnected cells has a hexagonal shape.

3. The boxing glove according to claim 1, wherein each cell of the at least one repeating pattern of interconnected cells comprises a plurality of interconnected cylinders.

4. The boxing glove according to claim 1, wherein:

the lattice comprises a three-dimensional arrangement of multiple repeating patterns of interconnected cells; and at least one characteristic of each interconnect cell of each one of the multiple repeating patterns of interconnected cells is different than the at least one other characteristic of each interconnected cell of at least one other of the multiple repeating patterns of interconnected cells, wherein the at least one characteristic is selected from the group consisting of a shape of each cell, an orientation of each cell, a size of each cell, or a wall thickness of each cell.

5. The boxing glove according to claim 4, wherein a shape of each cell of each one of the multiple repeating patterns of interconnected cells is different than the shape of each cell of at least one other of the multiple repeating patterns of interconnected cells.

6. The boxing glove according to claim 4, wherein a size of each cell of each one of the multiple repeating patterns of interconnected cells is different than the size of each cell of at least one other of the multiple repeating patterns of interconnected cells.

7. The boxing glove according to claim 4, wherein the lattice further comprises a finger region.

8. The boxing glove according to claim 7, wherein:

the finger region comprises a first repeating pattern of the multiple repeating patterns of interconnected cells;

the back hand region comprises a second repeating pattern of the multiple repeating patterns of interconnected cells; and the first repeating pattern is different than the second repeating pattern.

9. The boxing glove according to claim 8, wherein:

the first repeating pattern comprises a pattern of differently sized cells; and the second repeating pattern comprises a pattern of identically sized cells.

10. The boxing glove according to claim 8, wherein:

a third repeating pattern of the multiple repeating patterns of interconnected cells is located at a transition region between the finger region and the back hand region;

a shape of the interconnected cells of the second repeating pattern and the third repeating pattern are the same; and the interconnected cells of the third repeating pattern are smaller than the interconnected cells of the second repeating pattern.

11. The boxing glove according to claim 7, wherein:

the rigid face sheet defines an interior surface of the finger region, the thumb region, the arm region, and the back hand region of the lattice.

12. The boxing glove according to claim 1, wherein:

the lattice further comprises a finger region; and at least the finger region, the arm region, and the back hand region combine to have a one-piece, seamless, and monolithic construction.

13. The boxing glove according to claim 12, wherein the thumb region has a one-piece, seamless, and monolithic construction and is separately formed relative to the finger region, the arm region, and the back hand region.

14. The boxing glove according to claim 13, wherein:

the thumb region comprises a series of protrusions and recesses;

the back hand region comprises a series of protrusions and recesses; and the protrusions of the thumb region nestably engage the recesses of the back hand region and the recesses of the thumb region nestably engage the protrusions of the back hand region to form the interface.

15. The boxing glove according to claim 1, further comprising an outer cover coupled with the lattice so that the lattice is interposed between the outer cover and the interior liner.

16. The boxing glove according to claim 1, wherein:

the lattice comprises a finger region a front arm region, and a palm region;

the lattice defines an interior cavity between the back arm region and the front arm region, and between the back hand region and the palm region; and the interior pocket comprises at least a portion of the interior cavity defined by the lattice.

17. The boxing glove according to claim 1, wherein the lattice comprises a tightening strap that is tightenable about the interior liner to reduce a size of the interior pocket.

18. A shock-absorption layer for a boxing glove, the shock-absorption layer comprising:

a lattice comprising an additively manufactured three-dimensional arrangement of at least one repeating pattern of interconnected cells, the lattice further comprising at least an arm region, a back hand region, and a connection region seamlessly connecting together the arm region and the back hand region, wherein the arm region has a first thickness, the back hand region has a second thickness, and the connection region has a variable thickness and wherein the first thickness is different than the second thickness; and wherein the lattice further comprises a separately formed additively manufactured thumb region, comprising a second three-dimensional arrangement of at least one repeating pattern of interconnected cells, that is directly attached to the back hand region at an interface, wherein the interface comprises a plurality of protrusions, of the separately formed additively manufactured thumb region, nestably engaged with a plurality of recesses, of the back hand region.

19. The shock-absorption layer according to claim 18, wherein the lattice further comprises a rigid face sheet, wherein the rigid face sheet is co-manufactured with the at least one repeating pattern of interconnected cells of the lattice and the rigid face sheet is made of the same material as the at least one repeating pattern of the interconnected cells.

20. A boxing glove, comprising:

an interior liner, comprising an exterior surface and an interior surface, wherein the interior surface defines an interior pocket configured to receive a hand of a user; and a shock-absorption layer, comprising a lattice comprising an additively manufactured three-dimensional arrangement of at least one repeating pattern of interconnected cells, the lattice further comprising at least a back hand region and a thumb region, wherein:

the thumb region is a separately formed additively manufactured thumb region that comprises a second three-dimensional arrangement of at least one repeating pattern of interconnected cells and that is directly attached to the back hand region at an interface;

the interface comprises a plurality of protrusions, of the separately formed additively manufactured thumb region, nestably engaged with a plurality of recesses, of the back hand region; and the lattice is coupled to the interior liner.

21. The boxing glove according to claim 20, wherein the lattice further comprises a rigid face sheet co-manufactured with the at least one repeating pattern of interconnected cells of the lattice and coupled with at least a portion of the exterior surface of the interior liner forming a one-piece monolithic construction with the at least one repeating pattern of interconnected cells.

* * * * *